US006564735B1

(12) United States Patent
Jackson

(10) Patent No.: US 6,564,735 B1
(45) Date of Patent: May 20, 2003

(54) FOLDING PONTOON BOAT

(76) Inventor: Carl L. Jackson, W5470 County Rd. A, Pickerel, WI (US) 54465

( * ) Notice: Subject to any disclaimer, the term of this patent is extended or adjusted under 35 U.S.C. 154(b) by 0 days.

(21) Appl. No.: 10/092,418

(22) Filed: Mar. 6, 2002

(51) Int. Cl.[7] ..... B63B 1/00
(52) U.S. Cl. ..... 114/61.1; 114/61.15; 114/353
(58) Field of Search ..... 114/61.1, 61.15, 114/61.16, 61.17, 61.18, 353, 354

(56) References Cited

U.S. PATENT DOCUMENTS

| | | | | |
|---|---|---|---|---|
| 2,876,728 A | | 3/1959 | Luger | 114/61 |
| 3,179,960 A | | 4/1965 | Nimmo | 9/2 |
| 3,193,851 A | | 7/1965 | Fiebelkorn | 9/1 |
| 3,877,094 A | | 4/1975 | Kelley | 9/1 T |
| 3,978,536 A | | 9/1976 | Howe | 9/2 C |
| 4,736,702 A | | 4/1988 | Gubin | 114/353 |
| 4,909,169 A | | 3/1990 | Skandaliaris et al. | 114/61 |
| 5,239,940 A | * | 8/1993 | Griffin | 114/353 |
| 5,265,550 A | | 11/1993 | Harper, Jr. | 114/61 |
| 5,377,608 A | | 1/1995 | Harper, Jr. | 114/61 |
| 5,570,971 A | * | 11/1996 | Rixen et al. | 403/381 |
| 5,870,966 A | | 2/1999 | Christian | 114/353 |
| 6,095,079 A | | 8/2000 | Smidt | 114/353 |
| 6,178,913 B1 | | 1/2001 | Brignolio | 114/353 |
| 6,234,103 B1 | * | 5/2001 | Emrich | 114/266 |

* cited by examiner

*Primary Examiner*—Stephen Avila
(74) *Attorney, Agent, or Firm*—Wilhelm Law Service; Thomas D. Wilhelm

(57) ABSTRACT

A folding pontoon boat which can be folded to a lesser width unfolded to a greater operating width. The boat can be launched in the folded configuration, unfolded on the water, and subsequently refolded to the reduced width on the water. The boat comprises pontoons, deck members, jamb plates at the inner sides of the deck members, and a hinge connecting inner sides of the deck members to each other. The jamb plates provide sufficient structure that the deck members are self-supporting and can support normal deck loading at the hinge without additional superstructure above the deck to support the hinge structure. A motor mount at the rear of the boat maintains a constant orientation as the boat is folded and unfolded between the reduced width configuration and the greater width configuration.

101 Claims, 5 Drawing Sheets

10
12
14
18
22
24
32
33
34
36
46 FM
54
56
58
60
62
64
66
67
68
81
P

FOLDING PONTOON BOAT

BACKGROUND

This invention relates to pontoon boats, and to difficulties associated with typical widths of pontoon boats.

Pontoon boats are widely employed both as pleasure craft and as work barges.

Typically, such vessels employ a deck disposed generally between a pair of buoyant hull members such as pontoons. The deck area is preferably constructed as large as possible to provide optimum accommodation for people and/or equipment. Desired length of the vessel can generally be accommodated as needed.

However, if the vessel must be transported on the highway, the magnitude of the width can be limited by limits on the width of a vehicle which can be legally transported on the road. In addition, although the weight of the boat is typically quite modest, the length and width dimensions of the boat can require a fairly large-dimension trailer. Typically, especially with respect to pleasure vessels, vehicle width limits on the roads operate as a functional limit of the widths to which such boats are built.

Even given the above criteria regarding width limits of vehicles on roads, pontoon boats typically require use of trailers specially designed for pontoon boats, which makes such trailers especially costly, and of limited use. Accordingly, it is common practice for a pontoon boat owner to not purchase a trailer for the boat, but to rely on marina service organizations or other service operators to trailer the boat to a launch location at the beginning of a boating season and to remove the boat from the water when the boating season is over. As a result, use of the pontoon boat is commonly limited to a single body of water in a given season. Further, since the boat is left in the water the entire season, plant life such as algae or mussels readily attach themselves to the vessel thereby hindering speed of the vessel, and adding to the periodic task of cleaning the hull e.g. at the end of the boating season.

In order to solve the trailering problem, it is known to convert a pontoon boat from an operating configuration to a reduced-width configuration. However, no such configuration is known to the inventor herein which provides readily usable conversion of the boat from the operating configuration to the reduced-width configuration wherein the outboard motor can appropriately be left mounted to the boat motor mount during launching, loading, and trailering of the boat.

It is an object of the invention to provide a multiple hull boat, such as a pontoon boat which has a longitudinally extending hinge at a mid-section of the boat, wherein jamb plates adjacent the hinge support the boat at the hinge, and wherein the hulls are secured to deck members proximate the outer sides of the deck members.

It is another object of the invention to provide a multiple hull boat hinged at a mid-section wherein the boat is free from superstructure supporting the deck members proximate the inner sides of the deck members.

It is yet another object of the invention to provide a multiple hull boat hinged at a mid-section wherein the design and configuration, structure, strength, and rigidity, of hinge and jamb plates can bear all vertical forces normally imposed on the hinge area of the boat.

Yet another object of the invention is to provide a multiple hull boat wherein bending resistance of jamb plates proximate a longitudinally-extending hinge, at bottom edges of the jamb plates, is greater than respective bending resistances at bottom edges of front and rear ends and outer sides, of the deck members.

Still another object of the invention is to provide a multiple hull boat wherein the deck members approximate an inverted "V" when the boat is folded.

A further object of the invention is to provide a multiple hull boat having a motor mount opening interrupting regular spacing of cross-members of the boat and wherein the motor mount opening has sides disposed inwardly of the outer sides of the deck.

A further object is to provide a motor mount which is mounted at locations displaced frontwardly of the rear of the deck members, and which maintains horizontal orientation of the motor mount when the boat is converted to a folded configuration.

Another object is to provide a folding multiple hull boat which includes a motor mount which transfers forward thrust from an outboard motor to cross-members disposed frontwardly of the rear ends of the deck members by at least one regular interval of cross-members of the boat.

Yet another object is to provide a folding multiple hull boat wherein the motor mount rises as the deck members extend upwardly when boat is being converted to the folded configuration.

A further object is to provide a folding multiple hull boat which includes a retraction device which has a line of retractive action passing below the hinge, and which, when converting the boat from the operating configuration to the folded configuration, thus exerts an upward vector sufficient to initiate upward movement of inner sides of deck at the hinge.

SUMMARY

This invention contemplates a folding pontoon boat which can be folded to a first lesser width for transport or storage and which can be unfolded to an operating configuration for use on the water. The boat can be launched in the folded configuration, unfolded on the water, and subsequently refolded to the reduced-width configuration on the water prior to loading the boat on a trailer for transport from the water to another location.

In a typical embodiment, the boat comprises first and second elongate pontoons, each having a front end and a rear end; first and second deck members, each having a front end and a rear end, a bottom, a top, an inner side, and an outer side, each inner side having a top edge disposed toward the top of the respective deck member and a bottom edge disposed toward the bottom of the respective deck member. The front and rear ends of the first deck member are aligned with the respective front and rear ends of the first pontoon. The front and rear ends of the second deck member are aligned with the respective front and rear ends of the second pontoon. The first pontoon is secured to the first deck member proximate the outer side of the first deck member and thereby defines a first boat section. The second pontoon is secured to the second deck member proximate the outer side of the second deck member and thereby defines a second boat section. First and second jamb plates are secured to the respective first and second deck members at the inner sides of the deck members. The boat further comprises a hinge hingedly connecting the inner sides of the first and second deck members to each other thereby to join the first and second boat sections to each other for pivotation of the first and second boat sections with respect to each other, between an operating configuration wherein the first and second elongate pontoons are spaced at a first relatively greater distance from each other and the first and second deck members, in combination, define a deck of the folding pontoon boat, having a common top surface extending between the respective outer sides of the first and second deck members and between front and rear ends of the first and second deck members, and wherein the outer sides of the first and second deck members comprise an outer edge of the deck, and a folded configuration wherein the first and second elongate pontoons are spaced proximate each other and the first and second deck members extend upwardly toward the respective inner sides.

In preferred embodiments, the pontoons are non-pivotally secured to the respective deck members.

In other embodiments, the pontoons are fixedly secured to the respective deck members.

In the folded configuration, the pontoons are spaced no more than about 6 inches from each other, preferably no more than about 3 inches from each other, more preferably about 1 inch from each other.

Preferably, the hinge connects the inner sides of the first and second deck members to each other at the respective bottom edges of the inner sides.

In preferred embodiments, the pontoons fold and rotate with the deck members thereby to bring lower portions of the pontoons into facing relationship with each other.

Preferred embodiments of the boat include a retraction device such as a hydraulic cylinder. A first end of the cylinder is mounted to one of the first pontoon or the first deck member. The second end of the cylinder is mounted to one of the second pontoon or the second deck member. The retraction device has a line of retraction action passing below the hinge, whereby a line of force acting through the retraction device when the boat is in the operating configuration exerts an upward vector on the deck members sufficient to readily initiate upward movement of the inner sides of the deck members.

Preferred embodiments of boats of the invention include a motor mount which rises, and maintains a substantially constant orientation, when the boat is being converted to the folded configuration.

In typical and preferred embodiments, the boat is free from superstructure above the top of the deck for supporting the deck members proximate the inner sides when the boat is in the operating configuration.

Preferably, the jamb plates are of such design and configuration, and of sufficient structure, strength, and rigidity, to bear all vertical force vectors normally imposed on the deck members proximate the inner sides. Such jamb plates typically have bending resistance capacities, with respect to forces applied at the lower edges of the jamb plates, which are substantially greater than the respective bending resistance capacities at the lower edges of the front and rear ends, and at the outer sides, of the deck members.

In preferred embodiments, when the boat is in the folded configuration, the deck members approximate the shape of an inverted "V", representing an angle having an apex proximate the hinge or jamb plates. Typical angles are about 50 degrees to about 65 degrees. Angles as small as 15 degrees to about 20 degrees are contemplated. Angles as large as 90 degrees are also contemplated. However, in the interest of efficiency, angles of about 60 degrees to about 65 degrees are most preferred.

In preferred embodiments, the deck members each comprise an array of transverse supporting structural cross-members extending along the length of the deck members, and a motor mount opening interrupting the generally regular spacing of the cross-members at the rear portion of the boat. The motor mount opening extends uninterrupted across the hinge line and outwardly from the hinge line to opposing sides of the opening disposed inwardly of the outer sides of the deck members.

In some embodiments, a motor mount is mounted to the deck members at locations at least some of which are displaced frontwardly of the rear ends of the deck members, and the motor mount maintains a substantially constant orientation when the boat is folded into the folded configuration.

Preferably, the motor mount is so designed and configured that forward thrust of an outboard motor mounted to the motor mount is transferred to the cross-members at one or more locations displaced frontwardly of the rear ends of the deck members by at least one of the regular intervals.

Preferably, the motor mount has a motor mounting locus positioned such that the lower drive unit of an outboard motor mounted thereto is positioned rearwardly of the pontoons.

In preferred embodiments, the motor mount comprises suspension arms extending transverse to the longitudinal axis of the boat, the motor mount being mounted to the deck members by a combination of support bars in one of the cross-members and the suspension arms, and cooperating slots in the other of the cross-members and the suspension arms, the slots extending transversely of the longitudinal axis of the boat, the support bars sliding in the slots as the boat is converted between the operating configuration and the folded configuration.

Preferably, the motor mount rises, and thereby lifts a motor mounted to the motor mount, as the boat is being converted to the folded configuration.

In preferred embodiments, the motor mount defines a mounting plate structure oriented for holding an outboard motor thereon in a generally upright configuration for propelling the boat in the operating configuration, and wherein the motor mount maintains the mounting plate structure so oriented for holding the outboard motor in a generally upright configuration when the boat is being converted from the operating configuration to the folded configuration.

Further to preferred embodiments, the motor mount so interfaces with the deck members that the motor mount rises as the deck members are being extended upwardly when the boat is being converted to the folded configuration.

Preferably, the retraction device has a line of retractive action passing below the hinge, whereby a line of force acting through the retraction device when the boat is in the operating configuration exerts an upward vector on the deck members sufficient to readily initiate upward movement of the inner sides of the deck members without mechanical assist from any concurrently-operating lifting structure. The preferred retraction device is a 2-way hydraulic cylinder.

In the alternative, the retraction device can comprise a ratchet and a flexible line, connecting the first and second boat sections to each other through the line of retractive action.

Figure 1:
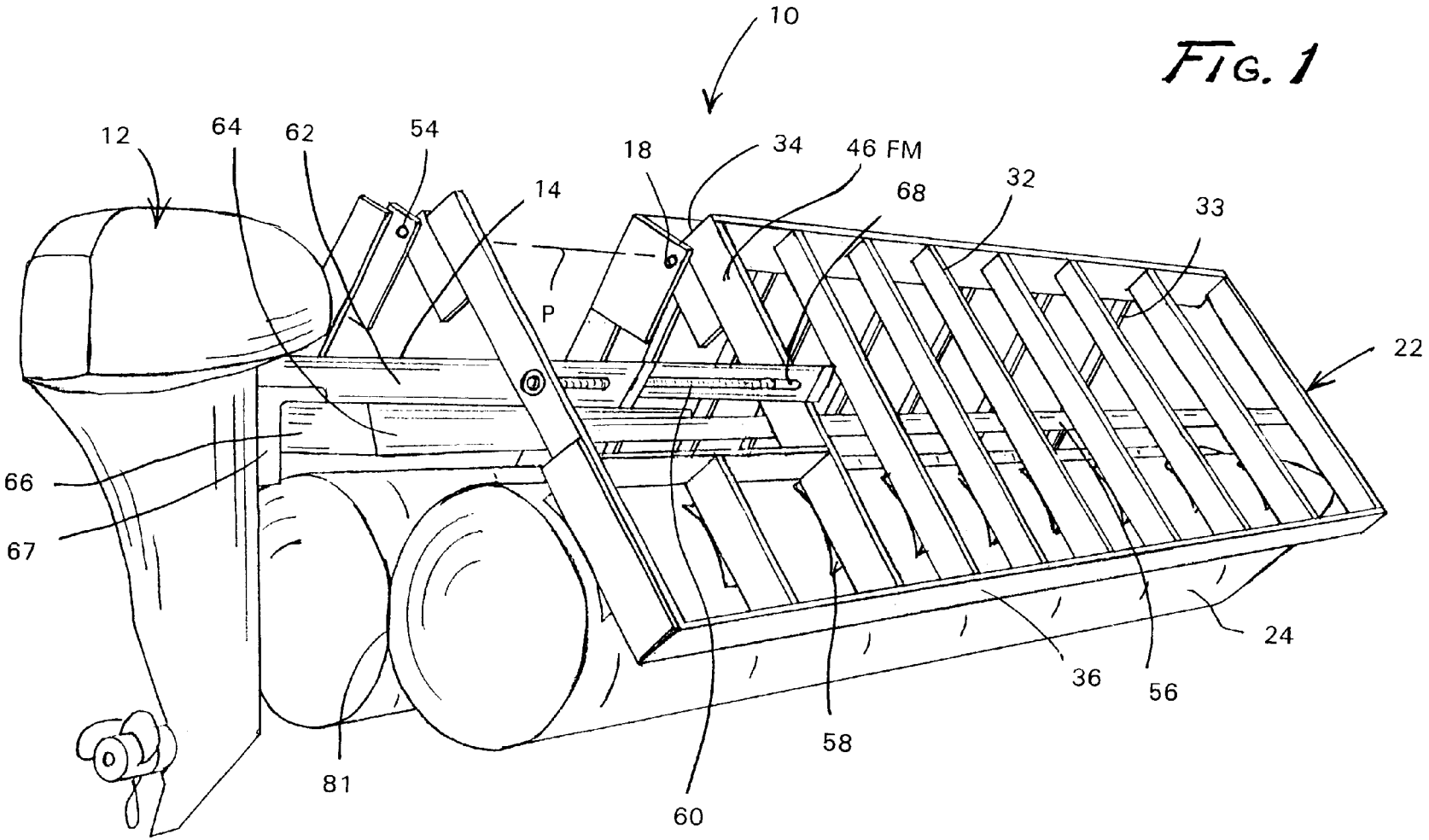
FIG. 1 shows a pictorial view of a pontoon boat of the invention, and an outboard motor mounted thereon, with the boat in the folded configuration.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 2:
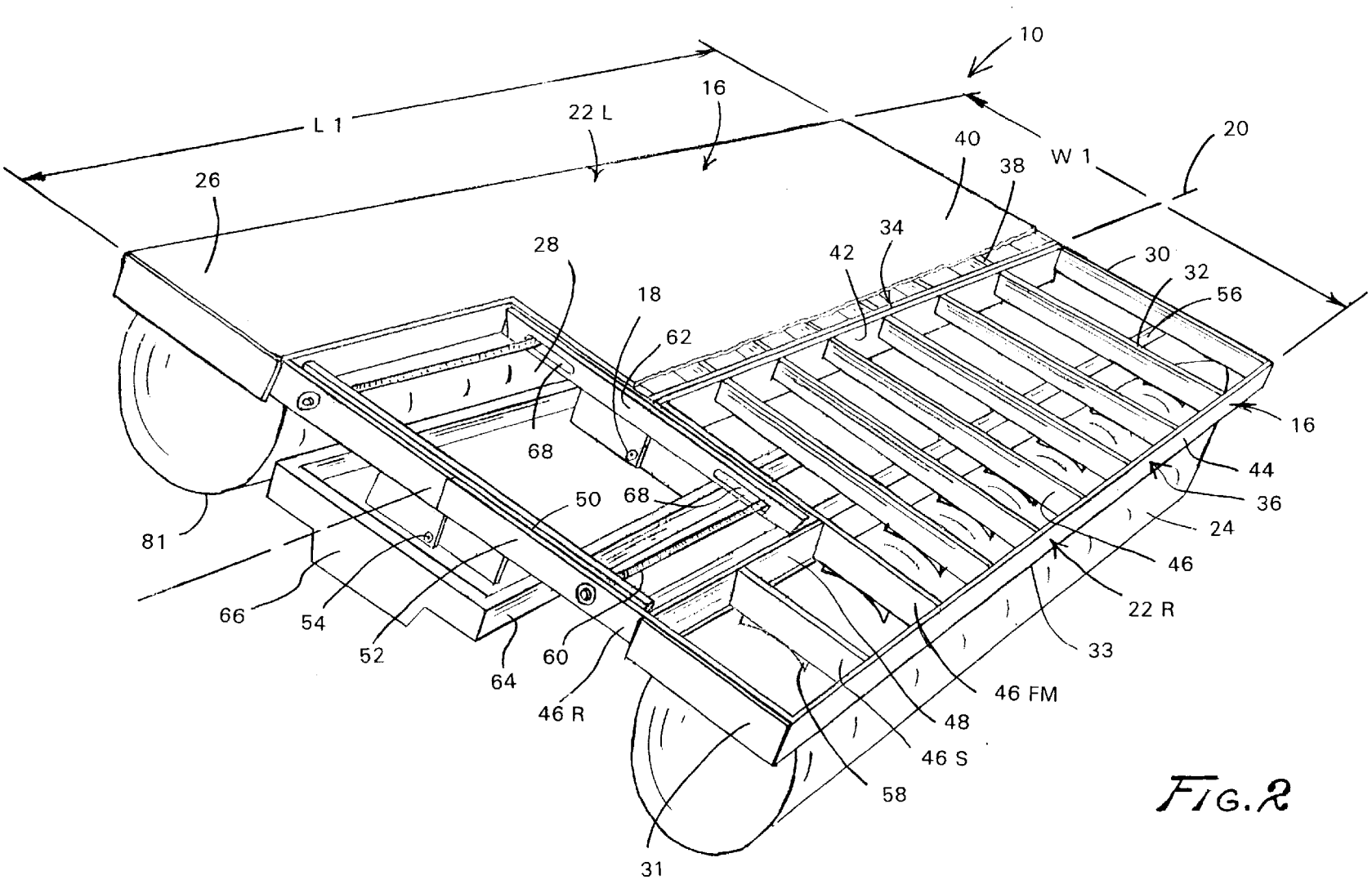
FIG. 2 shows a pictorial view of the pontoon boat of FIG. 1, in the operating configuration, with the motor deleted.
Figure 3:
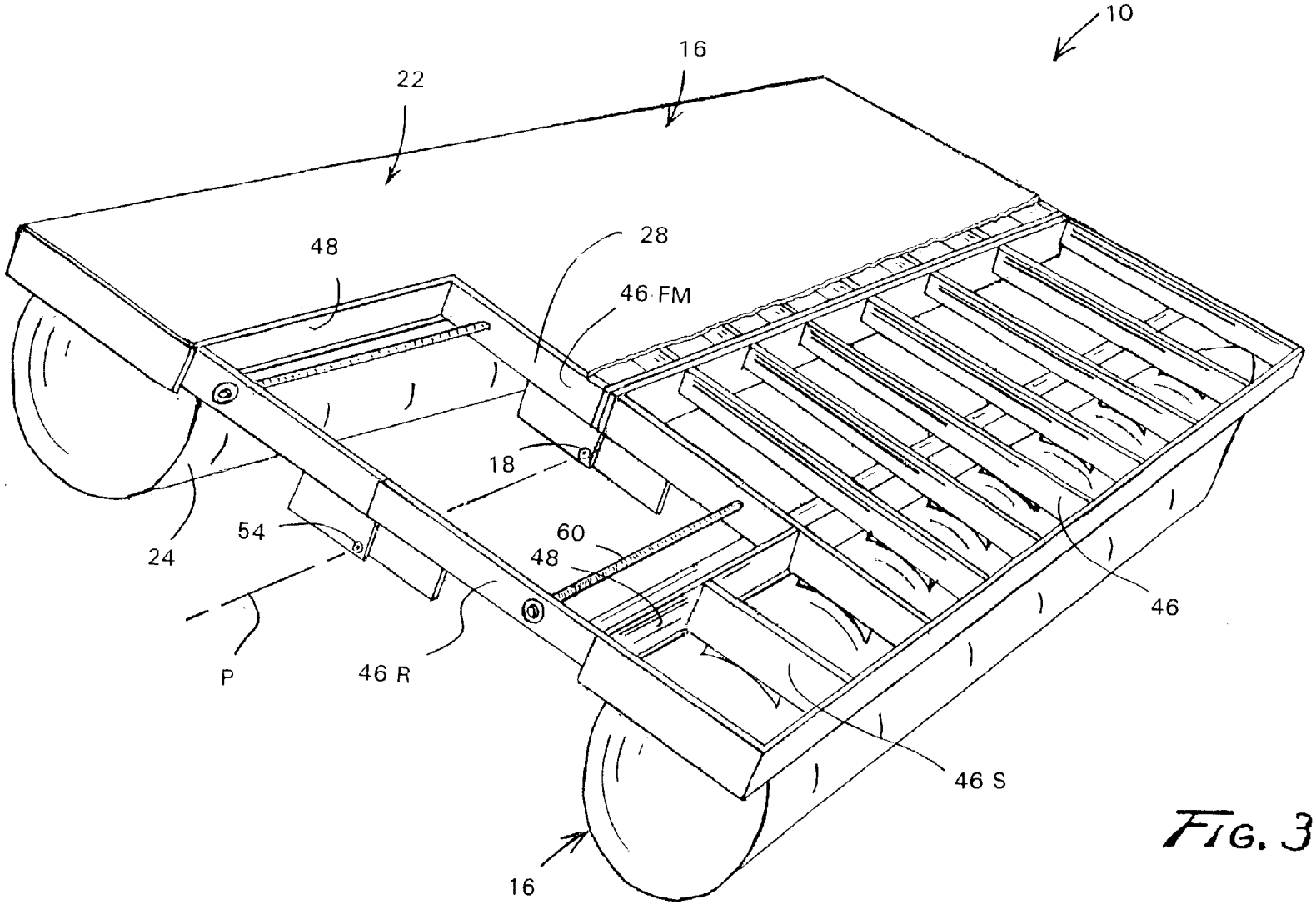
FIG. 3 shows a pictorial view of the pontoon boat of FIG. 2 with the motor mount removed.

Referring now to the drawings, FIG. 1 illustrates a pontoon boat 10 of the invention in the folded, transport configuration, with an outboard motor 12 mounted at the rear of the boat by a motor mount 14. FIG. 2 shows the boat of FIG. 1 in the operating configuration, without the motor. FIG. 3 shows the boat in the operating configuration, but without the motor mount.

As illustrated in FIGS. 1–3, boat 10 includes first and second, left and right, boat sections 16. Since the boat sections are mirror images of each other, only one boat section will be described. Boat sections 16 are connected to each other, for pivotation with respect to each other, by a longitudinally extending hinge 18. In the illustrated embodiments, hinge 18 extends along longitudinal axis 20 of the boat. Each boat section 16 includes a deck member 22 and a pontoon 24.

Pontoons 24 are conventionally available pontoons typically used on pontoon boats. Any conventional pontoon or other elongate floatation hull which can be used on a conventional pontoon or other multiple hull boat is suitable for use in boats of the invention. Specification of length, diameter, material of construction, and the like, of pontoons or other hulls for boats of the invention can be determined based on, for example, length, width, and weight of the boat as though the boat were a conventional pontoon boat. Accordingly, pontoons 24 need not be further specified here, as those skilled in the art can select appropriate pontoons or other hulls for use in boats of the invention.

Deck members 22, in combination, define the deck 26 of the boat, and a motor mount opening 28 disposed toward the rear of the boat. Each deck member 22 has a length "L1", a width "W1", a front end 30, a rear end 31, a top 32, a bottom 33, an inner side 34, and an outer side 36. Each deck member 22 includes a frame 38 and a sheet-like deck element 40 overlying and covering the frame. Frame 38, as illustrated, includes a first longitudinally-extending inner stringer 42 at inner side 34 of the deck member adjacent hinge 18, and a second longitudinally-extending outer stringer 44 at outer side 36 of the deck member. An array of transverse cross-members 46 are spaced at generally regular intervals along the length of the deck member and connect the stringers to each other, thereby to make a rigid cross-braced deck frame.

Outer stringer 44 extends from the front end 30 of the deck member to the rear end 31 of the deck member. Inner stringer 42 is shorter than the outer stringer, and extends from the front end of the deck member to the front end of motor mount opening 28, and connects to a cross-member 46FM which forms a portion of the front end of the motor mount opening.

As with most of the cross-members, cross-member 46FM connects inner stringer 42 to outer stringer 44. A secondary bridge stringer 48 extends from cross-member 46FM to cross-member 46R proximate the rear end of the deck member, and defines a side of the motor mount opening. Additional short cross-members 46S can extend from secondary bridge stringer 48 to outer stringer 44 at the regular spaced intervals, or at any other spacing desired for structural integrity of frame 38 between cross-members 46R and 46FM, or for other purposes.

In the illustrated embodiment, a front surface 50 of cross-member 46R defines the rear end of the motor mount opening and a rear surface 52 of cross-member 46R generally defines the rear end of the deck member. As illustrated in FIGS. 1–3, the cross-members 46R of the respective first and second deck members are connected to each other by a second hinge 54 which has a pivot axis which is aligned with the pivot axis of hinge 18. Accordingly, each deck member can pivot as a single unit about hinges 18 and 54, thus to pivot the first and second deck members with respect to each other, from a folded configuration illustrated in FIG. 1 to the open and operating configuration illustrated in FIG. 2.

As used herein, the phrase "operating configuration" refers to the normal, flat-deck, or parallel-deck, configuration of the boat sections, and especially the deck members, with respect to each other, when the boat is underway and in typical use wherein an extension of the top 32 of a first one of the deck members generally corresponds with the top 32 of the other one of the deck members.

Figure 6:
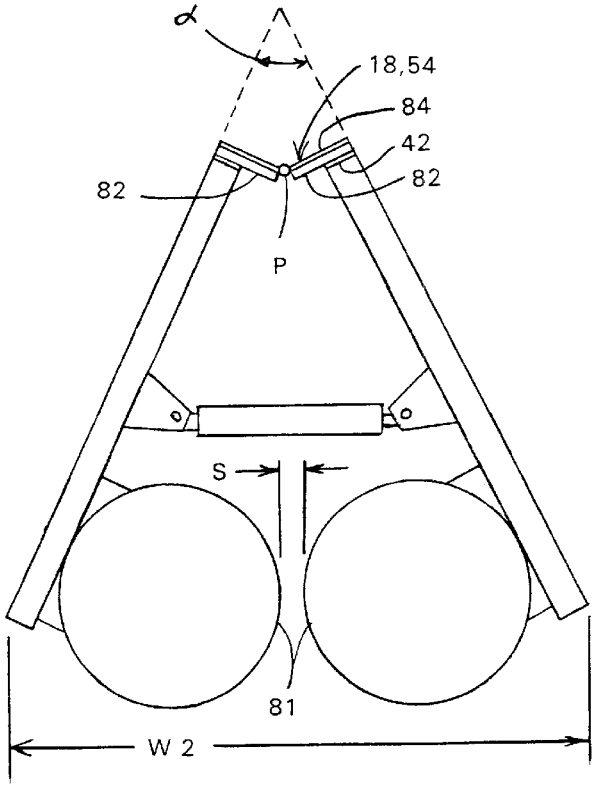
FIG. 6 shows a representative end elevation view as in FIG. 5, with the boat in the folded configuration.

As used herein, the phrase "folded configuration" refers to the configuration of the boat sections, and especially the deck members, with respect to each other, when the width of the boat has been reduced for trailering and/or storage and wherein the tops 32 of the respective deck members at sheeting 40 form an acute angle $\alpha$, as shown in FIG. 6.

Preferably, an intermediate longitudinal stringer 56 extends under the cross-members at the bottom 33 of the respective deck member, from the front end of the deck member to the rear end of the deck member, and thereby connects the cross-members to each other for enhanced structural rigidity.

The various elements of the frame can be connected to each other in any suitable manner. Welding is preferred. More or fewer bracing members than shown in the drawings can be employed as needed for structural integrity of the deck members, and the resulting overall structural integrity of the boat.

The stringers and cross-members can be made of any suitable material which provides the desired levels of structural strength, rigidity, and cost-effectiveness, along with the ability to tolerate the normal wet-use environment of a boat. Accordingly, for ordinary consumer use, in ordinary boat sizes which employ low to mid-range powers of outboard motors, aluminum frame members are preferred based on cost effectiveness of the material in light of the strength obtained from the material.

The frame of a given deck member is connected to the underlying pontoon 24 by any suitable structure. Brackets 58 are illustrated in the drawings. Other connective devices can well be used, including devices which enable the pontoon to pivot with respect to the frame as the boat is converted to the folded configuration.

Still referring to a deck member 22, a support bar 60 for supporting motor mount 14 extends longitudinally of the boat from cross-member 46FM at the front of the motor mount opening to cross-member 46R at the rear of the motor mount opening, and is supported at cross-members 46FM and 46R. Support bar 60 is spaced from but proximate secondary bridge stringer 48 at the side of the motor mount opening.

Boat 10 includes both left 22L and right 22R deck members configured generally as described above, joined together at hinges 18 and 54, for pivotation about the hinges. The fronts and rears of the deck members correspond generally with the front and rear of the boat. Similarly, the outer sides of the deck members correspond generally with the outer sides of the boat. The top surfaces of the deck members, in combination, define a deck of the boat having a top surface corresponding with the top surfaces of the sheeting 40 of the deck members.

Figure 4:
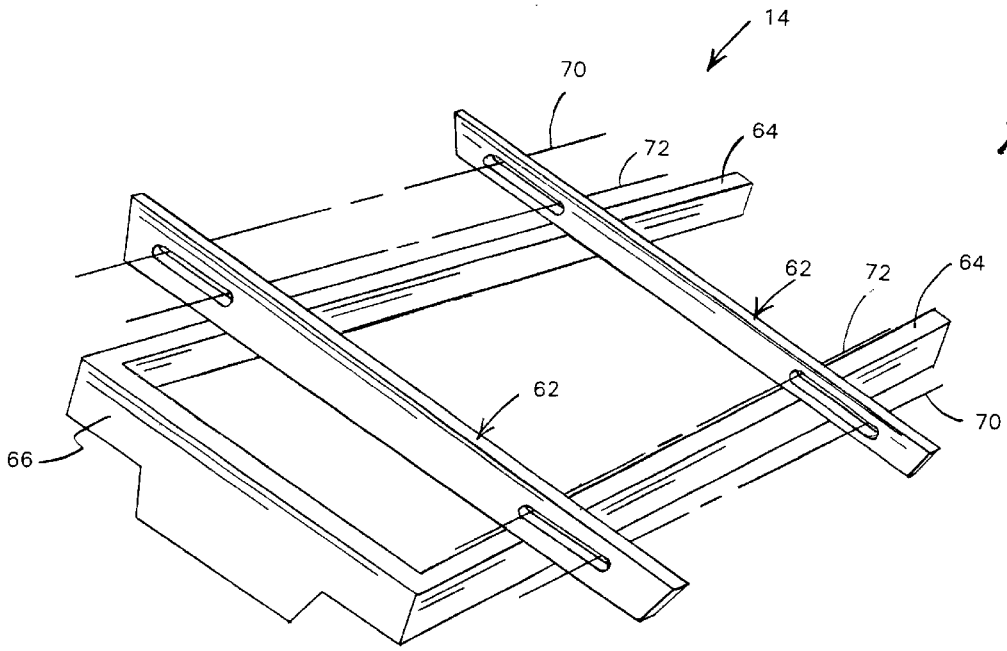
FIG. 4 shows a pictorial view of the motor mount illustrated on the boat in FIGS. 1 and 2.

Referring to FIGS. 2 and 4, motor mount 14 includes transversely extending front and rear suspension arms 62, longitudinally extending support arms 64, and transversely extending mounting plate structure 66. Suspension arms 62 provide an interface of the motor mount with the deck members at support bars 60. Mounting plate structure 66 provides an interface of the motor mount with mounting brackets 67 or the like of outboard motor 12 and extends between left and right support arms 64. Support arms 64 provide interfaces between the suspension arms and the mounting plate structure, and thus mount the suspension arms to the mounting plate structure. As with the respective frame members, the respective motor mount elements can be made of any suitable material which provides the strength required of the motor mount, and which tolerates the wet environment to which boats are subjected. As with the frame members, aluminum can be used. But since the motor mount is typically subjected to substantial forces from the outboard motor, preferred material for use in all motor mount elements, as well as support bars 60, in structurally more demanding embodiments such as where relatively larger outboard motors are used, is stainless steel.

Referring now to FIGS. 2–4, in the exemplary embodiments illustrated, suspension arms 62 extend generally the full width of the motor mount opening, and are spaced from each other on support arms 64 such that the spacing of the suspension arms positions the suspension arms generally at the front and rear ends of the motor mount opening, preferably in close, facing relationship, or in surface-to-surface relationship, with cross members 46FM and 46R respectively.

At each end of each suspension arm 62, one of the support bars 60 extends through a slot 68 in the suspension arm such that each bar 60 extends through a slot in each of the suspension arms proximate the respective ends of the suspension arms. Slots 68 extend transversely of the longitudinal axis of the boat, thus to enable transverse movement of the bars with respect to the suspension arms at slots 68. Each slot is positioned, sized, and configured such that the respective bar 60 is proximate an outer end of the slot when the boat is in the open and operating configuration of FIGS. 2, 3, and 5; and is proximate an inner end of the slot when the boat is in the folded configuration shown in FIGS. 1 and 6. Centerlines 70 in FIG. 4 illustrate the general locations of bars 60 when the boat is in the operating configuration. Centerlines 72 in FIG. 4 illustrate the general locations of bars 60 when the boat is in the folded configuration. The position and length of each slot on a given suspension arm is selected to accommodate anticipated movement of the respective support bar 60 as the boat is converted between the operating configuration and the folded configuration. Slot length can be extended in some instances, but generally is not preferred.

As suggested by the above description, motor mount opening 28 interrupts the generally regular spacing of the cross-members at a rear portion of the boat. As seen in e.g. FIGS. 2 and 3, and viewed in the operating configuration, the motor mount opening extends uninterrupted across the longitudinal axis 20 of the boat, and thus across a line of extension (not shown) representing the hinge line or pivot axis "P" of hinge 18, to opposing sides of the opening which are disposed inwardly of the outer sides of the respective deck members. Suitable deck sheeting can, of course, be mounted to motor mount 14 e.g. at suspension arms 62.

Figure 5:
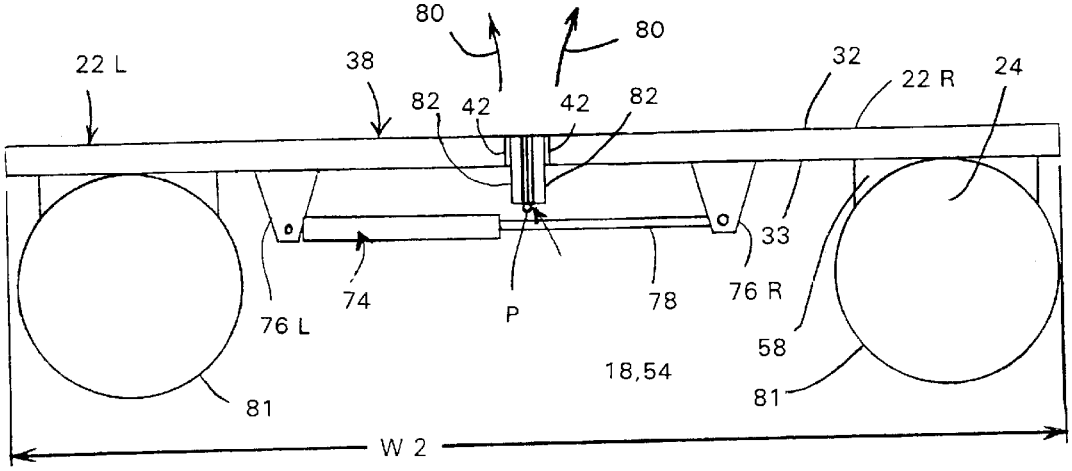
FIG. 5 shows a representative end elevation view of a pontoon boat of the invention, in the operating configuration.

Referring to FIGS. 5 and 6, a retraction device such as a 2-way hydraulic cylinder 74 is mounted below frames 38 of the deck members. A first end of the hydraulic cylinder 74 is mounted to the left deck member 22L through a first bracket 76L. A second end of the hydraulic cylinder 74 is mounted to the right deck member 22R through a second bracket 76R. The mounting of cylinder 74 to brackets 76L, 76R contemplates pivoting cylinder 74 with respect to brackets 76L, 76R as the boat is converted between the folded configuration and the operating configuration.

While cylinder 74 is shown mounted to deck members 22L, 22R, cylinder 74 can in the alternative be similarly mounted to the respective pontoons. Hydraulic cylinder 74 acts through ram 78 which defines a line of retractive action through the axis of ram 78. In all cases, the line of retractive action passes below the pivot axis of hinge 18.

Referring especially to FIG. 5, since the line of retractive action passes below hinge 18, a retractive force on ram 78 applies an upward vector to the decks at hinge 18. Such upward vectors are illustrated at arrows 80. The power of cylinder 74 is selected, and the cylinder is so positioned, that the retractive force of the ram, when the boat is in the operating configuration shown in FIG. 5, exerts an upward vector on the deck members sufficient to readily initiate upward movement of the inner sides of the deck members without any other mechanical assist. The greater the distance between the line of retractive action through ram 78, and the pivot axis "P" of hinge 18, the greater the effect of a given force applied at ram 78. Similarly, the less the distance between the line of retractive action and the pivot axis of hinge 18, the less the effect of a given force applied at ram 78. Accordingly, the force capacity of cylinder 74 and the location of the line of retractive action can be designed in combination to achieve the desired lifting effect on the inner sides of the deck members at hinge 18.

At the same time, the pontoons, which are preferably fixedly mounted to the bottoms 33 of the respective deck members, are drawn toward each other and are so rotated about hinges 18 and 54 that lower portions 81 of the pontoons are brought into facing relationship with each other by the time the folding action has been completed. The limit of the retraction illustrated in FIGS. 1 and 6 is generally related to the distance between pontoons 24. By bringing the pontoons close to each other, and thus bringing the outer sides of the deck members closer to each other, the overall width "W2" of the pontoon boat is reduced from a greater dimension in the operating configuration to a lesser dimension in the folded configuration. The closer the pontoons can be brought to each other, the more effective is the folding action in reducing the width of the boat in the folded configuration.

Thus starting, for example, with a pontoon boat which is about 96 inches wide in the operating configuration, and wherein the pontoons have diameters of about 24 inches, the width of the boat can be reduced in the folded configuration to about 65 inches. The degree of reduction in width depends on the specific dimensions of the various elements of the boat such as pontoon diameter, pontoon location on the deck members, deck thickness, positions of the pontoons relative to the outer sides of the deck members, and the like. In addition, the degree of reduction depends on the space between the pontoons when the boat is in the folded configuration. In preferred spacing, the pontoons are spaced about 1 inch from each other. Greater spacings can be tolerated, such as about 3 inches, about 6 inches, or more, keeping in mind that such increases in spacing increase the overall folded width dimension of the boat. Typically, the preferred 1 inch spacing optimizes the folded width while tolerating minor misalignments e.g. between the pontoons, or vibrations or other minor movements of the boat elements during transport of the boat.

In the open configuration at 96 inches, the boat would require a special purpose trailer, and careful maneuvering for trailering and otherwise towing the boat. By contrast, at 65 inches in the folded configuration, a wide variety of boat trailers can be employed, and trailering and towing represent typical trailer operations with single hull boats whereby trailering and towing are facilitated in the folded configuration.

In light of the above considerations, and given the above exemplary dimensions, with the pontoons spaced about 1 inch apart, a typical angle $\alpha$ is about 65 degrees. Angles as low as 15 or 20 degrees are contemplated, for example, where the pontoons have especially small diameters and/or wherein the respective boat elements are made of especially light-weight materials, or wherein pivot axis "P" is lowered relative to the bottoms of the deck members. Similarly, all angles a between about 15 degrees on the low end and about 90 degrees on the high end, are contemplated.

Returning now to the folding action exemplified by e.g. FIGS. 5 and 6, cylinder 74 can be a single action cylinder, active only for lifting the deck members at hinge 18. In such embodiments, the center of gravity must be sufficiently high that gravity is effective to lower the center of the boat e.g. at hinge 18 when lift force of cylinder 74 is released. Preferably, however, cylinder 74 is a 2-way acting cylinder which is powered in both the retraction direction and the extension direction. By using a 2-way cylinder, the configuration of the boat can be positively controlled by cylinder 74 both in folding the deck to the folded configuration and in unfolding the deck to the operating configuration. Further, the angle $\alpha$ can be positively maintained so long as the angle is substantially less than the 180 degrees extant when the boat is in the operating configuration. Namely, in the folded configuration illustrated in FIG. 6, cylinder 74 positively maintains the spacing "S" between the pontoons at a constant dimension wherein the pontoons can neither come closer together nor move farther apart.

When the boat is in the operating configuration, downward forces exerted on the deck members are distributed about the projected surface area of the deck sheeting, and transferred to frames 38 of the deck members. According to conventional structural analysis, the downward forces are transferred from the deck frames, as downwardly directed forces, to pontoons 24 and hinge 18. As a further critical consideration of the structure of boat 10, jamb plates 82 are mounted at the respective inner sides 34 of each of deck members 22L and 22R. The function of the jamb plates is to receive, to absorb, and to redistribute, the downward forces which reach the vicinity of hinge 18. In the illustrated embodiments, each jamb plate 82 extends the full length of inner side 34 of the respective deck member, and is disposed between hinge 18 and the respective stringer 42. Each jamb plate has a top edge generally flush with the top 32 of the deck member and a bottom edge which extends below the bottom 33 of the deck member.

Structurally, the jamb plates function as reinforcements of the inner stringers 42 at the inner sides of the frames. Typically, the jamb plates have greater top-to-bottom depth than the inner stringers, and have greater cross-sectional bending resistance in the vertical direction than inner stringers 42. The strength requirements of the jamb plates can be met with a combination of depth, thickness, and cross-sectional configuration whereby the jamb plates receive and absorb the downward forces at hinge 18. In a typical deck member 48 inches wide and 16 feet long, top-to-bottom depth of inner and outer stringers 42 and 44, and cross-members 46, can be e.g. about 3.5 inches to about 4 inches, and cross-sectional thickness of a respective stringer or cross-member is about 0.25 inch. By comparison, jamb plates on such deck member are preferably about 6 inches deep top-to-bottom, and about 0.25 inch to about 0.38 inch thick, and are mounted in face-to-face relationship with the inner stringers.

The function of the jamb plates can be combined with that of the inner stringers by fabricating the inner stringers of sufficiently robust cross-section material to provide the function of the jamb plates in a single unit represented by a more robust inner stringer. The function of the jamb plate can, in principle, be provided by a reinforced inner stringer having the same top-to-bottom depth as the rest of the frame, and a greatly increased stringer cross-sectional thickness. However, as illustrated in FIGS. 5 and 6, each jamb plate 82 preferably has greater depth top-to-bottom than the top-to-bottom depth of the respective inner stringer or other element of the respective deck member.

Typically, a jamb plate 82 extends the full length of the inner side of the respective deck member. Hinge 18 is preferably of a design known as a piano hinge, which has first and second elongate leaves 84, each having multiple pivot knuckles spaced along the length of the leaf. As with the jamb plates, hinge 18 typically extends the full length of the deck member, ending at the front end of motor mount opening 28. As illustrated in FIGS. 5 and 6, the leaves of hinge 18 are mounted in surface-to-surface relationship to the facing surfaces of the jamb plates. Thus, hinge 18 is fully reinforced along its length by jamb plates 82.

As illustrated in FIGS. 5 and 6, the composite structure at hinge 18 must be substantially robust to receive and absorb the downward forces proximate the hinge. Such robustness can be provided in a number of ways. What is critical is that the composite structure at hinge 18 provides sufficient depth and strength of the composite structure to receive and absorb, proximate the top and bottom edges of the structure, the forces received proximate the hinge. Thus, the composite structure must provide abutment surface proximate the top of the composite hinge structure, which abutment surfaces on the respective composite jamb plate structures can interact with each other, in combination with the forces acting through the pivot pin of the hinge, thus to distribute and absorb the forces acting on the deck in the hinge area.

While separate jamb plates are illustrated, and are preferred, the function of the jamb plates can instead be provided by a sufficiently robust hinge 18, by an increased strength inner stringer 42, or by a combination of reinforcements to the inner stringer and the hinge. However, in the interest of using commonly available off-the-shelf raw materials, separate jamb plates are preferred.

In any event, the pivot axis of hinge 18 is positioned at the bottom of the composite hinge structure.

When boat 10 is being converted from the folded configuration of e.g. FIGS. 1 and 6 to the operating configuration of FIGS. 2, 3, and 5, as the deck members approach a parallel relationship with each other, the retraction line of action of the ram approaches a parallel relationship with the tops of the deck members, whereby the vertically-oriented forces exerted on the deck members by cylinder 74 are substantially reduced. At the same time, the effect of gravitational forces on the deck members are increased.

As the deck members reach a parallel relationship, namely when an extension of the top of one deck member becomes an extension of the other deck member, the top edges of the hinge composite structure come into the above noted abutment with each other, thus to positively arrest downward movement of the deck members as the deck members combine to form a single boat deck.

By the time the deck members have reached the operating configuration, cylinder 74 is applying reduced levels of the vertical forces on the deck members, while jamb plates 82 and hinge 18 take primary control of the vertical forces which reach the hinge area when the jamb plates come into abutment with each other. Thus, a downward force at the hinge area puts the hinge leaves in tension with respect to each other at the hinge pin, which is at pivot axis "P", as well as putting the entire composite hinge support structure in tension adjacent the hinge pin. At the same time, such downward force brings the composite hinge support structure such as jamb plates 82 into compressive face-to-face abutment with respect to each other. Thus, the hinge support structure, exemplified by jamb plates 82, provides a tension-compression combination at hinge 18 whereby efficiency of such support structure is generally increased by increasing the depth of the support structure. Accordingly, the top-to-bottom depth of the hinge support structure is typically greater than the top-to-bottom nominal depth of the frame away from the hinge support structure.

By reinforcing the hinge with jamb plate structure or like composite structure, downward forces commonly exerted on the deck at the area of hinge 18, whether by boat structure or by a load being carried by the boat, are absorbed and distributed by the jamb plate structure. Accordingly, by using sufficient jamb plate or like structure to reinforce hinge 18, in combination with sufficient depth of the jamb plate structure, the jamb plates provide the strength required of the deck superstructure above the pontoons, and no additional superstructure need be employed above the top of the deck to support the deck members with respect to each other proximate the inner sides of the respective deck members, and to keep the deck flat across hinge 18. Thus, by appropriate design and configuration of the jamb plate structure adjacent hinge 18, providing at such jamb plate structure sufficient strength and rigidity, the jamb plate structure can bear all vertical forces normally imposed on the deck members proximate the inner sides of the deck members.

Typically, in order to provide the reinforcing strength required of the jamb plates, the jamb plates have substantially greater bending resistance capacities, especially at the lower edges of the jamb plates, than are extant at respective lower edges of the frame at the front and rear ends, and at the outer sides, of the deck members.

Thus, as used herein and in the claims which follow, the phrase "jamb plates" includes not only the jamb plates as separate elements as illustrated, but also includes all equivalent reinforced composite or support structure wherein the function of separate jamb plates is achieved by reinforcing the inner stringers, the hinge leaves, or other reinforcing structure.

Referring again to FIG. 5 wherein the boat is shown in the operating configuration, the boat is converted to the folded configuration of FIG. 6 by initiating retractive force on ram 78 thereby retracting the ram into cylinder 74. As the ram is retracted into cylinder 74, the deck members begin to pivot about hinges 18 and 54, and with respect to each other, at inner sides 34. As the deck members pivot with respect to each other and with respect to hinges 18 and 54, the inner sides of the deck members rise with hinges 18 and 54 to an elevated position such that the deck members approximate the shape of an inverted "V" having an apex proximate the jamb plates, and illustrated in FIG. 6 at the origin of angle $\alpha$.

In keeping the folded width of the boat reasonably small, so as to meet objectives related to width reduction, the pontoons are typically mounted to the deck members proximate the outer sides of the deck members, consistent with good balance and stress distribution when the boat is being operated on a body of water. While the pontoons can be mounted to the deck members so as to pivot with respect to the deck members, limited width reduction is achieved thereby, so the pontoons are preferably fixedly secured to the deck members as by welding the pontoons to brackets 58.

As the inner sides of the deck members are being lifted by retraction of ram 78 and pivoting of hinges 18 and 54, support bars 60 are being lifted and moved inwardly toward longitudinal axis 20. As the bars are lifted and moved inwardly, the bars slide inwardly along slots 68 and the tops of the bars interface with the top edges of the slots, thus exerting upward forces on the suspension arms at the tops of slots 68, and so lifting the suspension arms. The lifting of the suspension arms at the front and rear of the motor mount lifts the entire motor mount while maintaining the motor mount in a consistent e.g. horizontal orientation, both front-to-back, and side-to-side. Thus, where the motor mount is in a horizontal orientation in the operating configuration, the motor mount remains in a horizontal orientation while the boat is being converted to the folded configuration and is maintained in a horizontal orientation while the boat is in the folded configuration.

Since the motor mount remains e.g. horizontal when the boat is folded, in principle, the motor can be left attached to the motor mount, if desired, when the boat is out of the water, e.g. for transport. In preferred embodiments, and as shown in the illustrated embodiments, the distance by which the motor mount is lifted when the boat is folded is sufficient to lift the motor high enough that the motor can be left in its down and operating position at all times such as during launching, loading, and trailering of the boat. Thus, not only can the motor be left attached, the lower unit of the motor typically does not need to be raised from the operating position wherein the lower unit of the motor is in a generally upright and vertical orientation.

Again referring to the motor mount, suspension arms 62 are in general facing relationship with cross-members 46FM and 46R. Longitudinally extending support arms 64 extend frontwardly of cross-member 46FM to at least the next cross-member to the front of cross-member 46FM. When motor 12 is driven in a forward direction, the motor thrust, in combination with the weight of the motor, as applied at the motor mount, typically has both a forwardly-directed vector and a downwardly-directed vector. The downwardly directed vector at the rear end of the motor mount translates to an uplift force at the forward ends of support arms 64, thus typically urging the support arms upwardly against the bottom surfaces of cross-member 46FM and any other of the more frontward cross-members to which the support arms extend. With the support arms thus in engagement with the bottom surfaces of the cross-members, and with the forward suspension arms in engagement with the rear surface of cross-member 46FM, the forward thrust of the motor is transferred to the cross-members so engaged by the suspension arms and the support arms.

While choosing to not be bound by theory, typically, most of the forward thrust is believed to be transferred, through the forward-facing surfaces of the suspension arms, to the rearward-facing surfaces of the respective cross-members 46FM. In any event, the forward thrust of the motor is transferred to the cross-members, and thus to the deck members, at locations displaced frontwardly of the rear ends of the deck members, by at least one, typically at least 2, regular intervals of the cross-members.

Using the same structural analysis, rearward thrust of the motor is transferred by the rear suspension arms to rear cross-member 46R, and thence to the remaining elements of the respective deck members.

Since it is anticipated that the outboard motor typically will be left mounted to the boat when the boat is in the folded configuration, with the motor in its upright operating configuration, such as with the lower unit extending downwardly as if the motor were in operation, the lower unit must be to the rear of the pontoons such that the pontoons can be brought into proximity with each other at e.g. about 1 inch spacing. Accordingly, the deck members and pontoons must be positioned longitudinally with respect to each other, and especially the motor mounting plate must be positioned with respect to the rear ends of the pontoons, so as to enable mounting of the motor to the motor mount at mounting plate structure 66 while maintaining the lower unit of the motor behind the rear ends of the pontoons when the lower unit is in its normal upright operating orientation.

Motor mount 14 has been described above in terms of support bars 60 being mounted to cross-members 46FM and 46R and slots 68 being disposed in suspension arms 62. The roles can be reversed whereby bars 60 are mounted on suspension arms 62 and extend into slots 68 in cross-members 46FM and 46R. In view of the disclosure herein, other similar sliding and cooperating structures can now be readily designed for supporting motor mount 14 from the respective deck members, and all such readily designed structures are intended to be comprehended by the scope of this disclosure and the appended claims.

Cylinder 74 can be powered by e.g. any conventionally available hydraulic power unit which can operate off the power system built into the boat. For example, where the boat runs on a 12 volt electric power supply, a 12-volt hydraulic power unit can be used to power cylinder 74.

Starting and stopping movements of ram 78 can be controlled by the physical limits of movement of the ram or by any desired set of switches (not shown) which can be activated e.g. by movement of deck members 22 during movement of the boat between the operating configuration and the folded configuration. If desired, cylinder 74 can be controlled by a conventional hand held hard-wired control unit wired to a power unit powering cylinder 74, or by a remote control unit which cooperates with a remote receiver which is mounted on the boat and which is wired to a power unit powering cylinder 74.

Still addressing the motor mount, as indicated above, deck sheeting (not shown) similar to sheeting 40 can be secured over suspension arms 62 to provide closure to the motor mount opening. Since, the motor mount remains horizontal in both the operating configuration of e.g. FIG. 1 and the folded configuration of e.g. FIG. 2, any desired housing, seating, or other structure can be secured to the motor mount with constant orientation of such structure. For example, a cabinet can be crafted atop the motor mount, and such apparatus as fuel tank, battery, and hydraulic unit to run cylinder 74 can be housed in such cabinet.

While boat 10 has been shown with a flat deck, rails, control column, seats and the like can be attached as desired. In a preferred boat, side rails and a control column are pivotally mounted at the tops of the deck members and are provided with latches or other securement devices whereby the rails and control column can be secured in upright orientations for use of the boat or can be secured collapsed against the deck sheeting for storage or transport of the boat. Similarly, deck chair receivers can be mounted into the deck, and chairs can be mounted to the deck when the boat is in the operating configuration, and are typically removed before the boat is converted to the folded configuration. Canopy and other desired appurtenances can be attached, as desired, when the boat is in the operating configuration.

While the retraction device has been illustrated as a 2-way hydraulic cylinder 74, other retractive devices are contemplated. A single action hydraulic cylinder can be used. Where pressurized air is available, a pneumatic cylinder can be used. Another retractive device comprises a ratchet connecting a flexible line such as a belt or rope between the respective deck sections, all having a line of retractive action below the pivot axis "P" of hinge 18.

While it is believed that converting the boat between the folded configuration and the operating configuration is enabled by the above disclosure, a brief description of such conversion is described as follows. Starting at the folded configuration shown in FIG. 1, and assuming that the boat is on a conventional bunk trailer or on a roller trailer wherein the pontoons are supported by rollers or bunks, and with the motor mounted on the motor mount in an upright orientation, the trailer and boat can be backed into the water at a conventional launch ramp for launching of the boat in the folded configuration. Since the center of gravity is generally quite low, namely in the area of the pontoons, the boat is quite stable in the water in the folded configuration. Accordingly, the boat can be launched in the folded configuration shown in FIG. 1. As the trailer and boat are backed into the water at the ramp, the boat floats off the trailer whereupon cylinder 74 is activated, thereby converting the boat from the folded configuration shown in FIG. 1 to the operating configuration shown in FIG. 2. The boat is then used as desired on the water, in the operating configuration.

When it is desired to take the boat out of the water, for example to go to another body of water, items attached to the deck are first removed or folded flat. Typically, any deck chairs are removed. Rails and the control column are folded flat against the deck. Any canopy framing is either removed or folded flat. The motor lower unit is left down, in the water. With the above items accomplished, and the boat still in the water, cylinder 74 is activated, retracting ram 78 and thereby drawing the pontoons and outer sides of the boat toward each other and correspondingly lifting upwardly on the deck members at hinge 18, thus to bring the boat to the folded configuration represented in FIG. 6.

With the boat in the folded configuration, and with the trailer in the water to receive the boat, the boat can be loaded onto the trailer and pulled from the water, ready for tie down and transport.

This invention applies to boats of any length, any width, any pontoon size, any motor size. Typically, all the elements are sized and configured to structurally complement each other in a given boat.

While specific exemplary materials and material dimensions are mentioned above for e.g. the frame members, jamb plates, and motor mount, such materials and dimensions are exemplary only, and do not represent the outer limits of the scope of the invention. Rather, a wide variety of materials can be used for the respective structural elements of boats of the invention. Correspondingly, each such material has its own set of properties which bears on the required dimensions and designs of the respective structural members. And the selection of material and frame member cross-section dimensions depends on the loads for which the boat is being designed. For example, a frame and motor mount configured for a boat equipped with a 5 horsepower outboard motor will not have adequate strength if a 150 horsepower motor is used. Similarly, a frame configured to carry a maximum deck load of 1000 pounds will not have adequate strength if a 5000 pound load is to be carried.

Regarding frame 38, the illustrated arrangement of cross-members and stringers is exemplary only, in that a wide variety of frame configurations can be used to provide the structural strength required of the deck 26. The required structural strength will, of course, vary depending, among other things, on the overall size of the boat, boat width, boat length, and anticipated deck loading. The frame structure can also make provision for under deck storage compartments, with frame members being preferably strategically located to accommodate such under deck storage without jeopardizing the structural integrity of the deck frame, the deck sheeting, or the ability of the deck to carry the anticipated loads and load distributions.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon, said first pontoon being secured to said first deck member proximate the outer side of said first deck member and thereby defining a first boat section, said second pontoon being secured to said second deck member proximate the outer side of said second deck member and thereby defining a second boat section, (c) first and second jamb plates secured to respective first and second deck members at said inner sides of said deck members; and (d) a hinge hingedly connecting said inner sides of said first and second deck members to each other thereby to join said first and second boat sections to each other for pivotation of said first and second boat sections with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of said first and second deck members and between front and rear ends of said first and second deck members, and wherein the outer sides of said first and second deck members comprise an outer edge of said deck, and a folded configuration wherein said first and second elongate pontoons are spaced proximate each other and said first and second deck members extend upwardly toward the respective inner sides.

2. A folding pontoon boat as in claim 1, said first and second pontoons being non-pivotally secured to the respective said first and second deck members.

3. A folding pontoon boat as in claim 1, said first and second pontoons being fixedly secured to the respective said first and second deck members.

4. A folding pontoon boat as in claim 1 wherein, in the folded configuration, said pontoons are spaced no more than about 6 inches from each other.

5. A folding pontoon boat as in claim 1 wherein, in the folded configuration, said pontoons are spaced no more than about 3 inches from each other.

6. A folding pontoon boat as in claim 1 wherein, in the folded configuration, said pontoons are spaced about 1 inch from each other.

7. A folding pontoon boat as in claim 3, said hinge connecting said inner sides of said first and second deck members to each other at the respective bottom edges of said inner sides and wherein, in the folded configuration, said pontoons are spaced no more than about 3 inches from each other.

8. A folding pontoon boat as in claim 1 wherein said first and second pontoons fold with said deck members thereby to bring lower portions of said first and second pontoons into facing relationship with each other.

9. A folding pontoon boat as in claim 1 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

10. A folding pontoon boat as in claim 1 and including a motor mount mounted in said folding pontoon boat, said motor mount rising, and maintaining a substantially constant orientation, when said folding pontoon boat is being converted to the folded configuration.

11. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon, said first pontoon being secured to said first deck member and thereby defining a first boat section, said second pontoon being secured to said second deck member and thereby defining a second boat section, (c) first and second jamb plates secured to respective first and second deck members at said inner sides of said deck members; and (d) a hinge hingedly connecting said inner sides of said first and second deck members to each other thereby to join said first and second boat sections to each other for pivotation of said first and second boat sections with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of said first and second deck members and between front and rear ends of said first and second deck members and wherein the outer sides of said first and second deck members comprise an outer edge of said deck, and a folded configuration wherein said first and second elongate pontoons are spaced proximate each other and said first and second deck members extend upwardly toward the respective inner sides, said folding pontoon boat being free from superstructure above the top of said deck for supporting said deck members proximate said inner sides when said folding pontoon boat is in the operating configuration.

12. A folding pontoon boat as in claim 11, said first and second pontoons being non-pivotally secured to the respective said first and second deck members.

13. A folding pontoon boat as in claim 11, said first and second pontoons being fixedly secured to the respective said first and second deck members.

14. A folding pontoon boat as in claim 11 wherein, in the folded configuration, said pontoons are spaced no more than about 6 inches from each other.

15. A folding pontoon boat as in claim 11 wherein, in the folded configuration, said pontoons are spaced no more than about 3 inches from each other.

16. A folding pontoon boat as in claim 11 wherein, in the folded configuration, said pontoons are spaced about 1 inch from each other.

17. A folding pontoon boat as in claim 13, said hinge connecting said inner sides of said first and second deck members to each other at the respective bottom edges of said inner sides and wherein, in the folded configuration, said pontoons are spaced no more than about 3 inches from each other.

18. A folding pontoon boat as in claim 11 wherein said first and second pontoons fold with said deck members thereby to bring lower portions of said first and second pontoons into facing relationship with each other.

19. A folding pontoon boat as in claim 11 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

20. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon, said first pontoon being secured to said first deck member and thereby defining a first boat section, said second pontoon being secured to said second deck member and thereby defining a second boat section, (c) first and second jamb plates secured to respective first and second deck members at said inner sides of said deck members; and (d) a hinge hingedly connecting said inner sides of said first and second deck members to each other thereby to join said first and second boat sections to each other for pivotation of said first and second boat sections with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of said first and second deck members and between front and rear ends of said first and second deck members and wherein the outer sides of said first and second deck members comprise outer edges of said deck, and a folded configuration wherein said first and second elongate pontoons are spaced proximate each other and said first and second deck members extend upwardly toward the respective inner sides, said jamb plates and said hinge, in combination, being of such design and configuration, and of sufficient structure, strength, and rigidity, to bear all vertical forces normally imposed on said deck members proximate said inner sides.

21. A folding pontoon boat as in claim 20, said first and second pontoons being non-pivotally secured to the respective said first and second deck members.

22. A folding pontoon boat as in claim 20, said first and second pontoons being fixedly secured to the respective said first and second deck members.

23. A folding pontoon boat as in claim 20 wherein, in the folded configuration, said pontoons are spaced no more than about 6 inches from each other.

24. A folding pontoon boat as in claim 20 wherein, in the folded configuration, said pontoons are spaced no more than about 3 inches from each other.

25. A folding pontoon boat as in claim 20 wherein, in the folded configuration, said pontoons are spaced about 1 inch from each other.

26. A folding pontoon boat as in claim 22, said hinge connecting said inner sides of said first and second deck members to each other at the respective bottom edges of said inner sides and wherein, in the folded configuration, said pontoons are spaced no more than about 3 inches from each other.

27. A folding pontoon boat as in claim 20 wherein said first and second pontoons fold with said deck members thereby to bring lower portions of said first and second pontoons into facing relationship with each other.

28. A folding pontoon boat as in claim 20 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

29. A folding pontoon boat as in claim 20 and including a motor mount mounted in said folding pontoon boat, said motor mount rising, and maintaining a substantially constant orientation, when said folding pontoon boat is being converted to the folded configuration.

30. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon, said first pontoon being secured to said first deck member and thereby defining a first boat section, said second pontoon being secured to said second deck member and thereby defining a second boat section, (c) first and second jamb plates secured to respective first and second deck members at said inner sides of said deck members; and (d) a hinge hingedly connecting said inner sides of said first and second deck members to each other thereby to join said first and second boat sections to each other for pivotation of said first and second boat sections with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of said first and second deck members and between front and rear ends of said first and second deck members and wherein the outer sides of said first and second deck members comprise outer edges of said deck, and a folded configuration wherein said first and second elongate pontoons are spaced proximate each other and said first and second deck members extend upwardly toward the respective inner sides, said front and rear ends, and said outer sides of said first and second deck members having respective bending resistance capacities with respect to forces applied at lower edges thereof, and said jamb plates having bending resistance capacities with respect to forces applied at lower edges thereof substantially greater than the respective bending resistance capacities at the lower edges of said front and rear ends and at said outer sides.

31. A folding pontoon boat as in claim 30, said first and second pontoons being non-pivotally secured to the respective said first and second deck members.

32. A folding pontoon boat as in claim 30, said first and second pontoons being fixedly secured to the respective said first and second deck members.

33. A folding pontoon boat as in claim 30 wherein, in the folded configuration, said pontoons are spaced no more than about 6 inches from each other.

34. A folding pontoon boat as in claim 30 wherein, in the folded configuration, said pontoons are spaced no more than about 3 inches from each other.

35. A folding pontoon boat as in claim 30 wherein, in the folded configuration, said pontoons are spaced about 1 inch from each other.

36. A folding pontoon boat as in claim 32, said hinge connecting said inner sides of said first and second deck members to each other at the respective bottom edges of said inner sides and wherein, in the folded configuration, said pontoons are spaced no more than about 3 inches from each other.

37. A folding pontoon boat as in claim 30 wherein said first and second pontoons fold with said deck members thereby to bring lower portions of said first and second pontoons into facing relationship with each other.

38. A folding pontoon boat as in claim 30 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

39. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon, said first pontoon being secured to said first deck member and thereby defining a first boat section, said second pontoon being secured to said second deck member and thereby defining a second boat section, (c) first and second jamb plates secured to respective first and second deck members at said inner sides of said deck members; and (d) a hinge hingedly connecting said inner sides of said first and second deck members to each other thereby to join said first and second boat sections to each other for pivotation of said first and second boat sections with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of said first and second deck members and between front and rear ends of said first and second deck members and wherein the outer sides of said first and second deck members comprise outer edges of said deck, and a folded configuration wherein said first and second elongate pontoons are spaced proximate each other and said first and second deck members extend upwardly toward the respective inner sides, and wherein, in the folded configuration, said first and second deck members approximate the shape of an inverted "V" having an apex proximate said jamb plates.

40. A folding pontoon boat as in claim 39, said first and second pontoons being non-pivotally secured to the respective said first and second deck members.

41. A folding pontoon boat as in claim 39, said first and second pontoons being fixedly secured to the respective said first and second deck members.

42. A folding pontoon boat as in claim 39 wherein, in the folded configuration, said pontoons are spaced no more than about 6 inches from each other.

43. A folding pontoon boat as in claim 39 wherein, in the folded configuration, said pontoons are spaced no more than about 3 inches from each other.

44. A folding pontoon boat as in claim 39 wherein, in the folded configuration, said pontoons are spaced about 1 inch from each other.

45. A folding pontoon boat as in claim 41, said hinge connecting said inner sides of said first and second deck members to each other at the respective bottom edges of said inner sides and wherein, in the folded configuration, said pontoons are spaced no more than about 3 inches from each other.

46. A folding pontoon boat as in claim 39 wherein said first and second pontoons fold with said deck members thereby to bring lower portions of said first and second pontoons into facing relationship with each other.

47. A folding pontoon boat as in claim 39 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

48. A folding pontoon boat as in claim 39 and including a motor mount mounted in said folding pontoon boat, said motor mount rising, and maintaining a substantially constant orientation, when said folding pontoon boat is being converted to the folded configuration.

49. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said first and second deck members each comprising an array of transverse supporting structural cross-members, and deck sheeting overlying said transverse supporting structural cross-members, said transverse structural cross-members extending transverse to a longitudinal axis of said folding pontoon boat, said transverse structural cross-members being spaced at generally regular intervals along respective lengths of the respective deck members, said front and rear ends of said first deck member being aligned with the respective front and rear ends of said first elongate pontoon, said front and rear ends of said second deck member being aligned with the respective front and rear ends of said second elongate pontoon, said first pontoon being secured to said first deck member and thereby defining a first boat section, said second pontoon being secured to said second deck member and thereby defining a second boat section, (c) a hinge defining a hinge line and hingedly connecting said inner sides of said first and second deck members to each other thereby to join said first and second boat sections to each other for pivotation of said first and second boat sections with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of said first and second deck members and between front and rear ends of said first and second deck members and wherein the outer sides of said first and second deck members comprise an outer edge of said deck, and a folded configuration wherein said first and second elongate pontoons are spaced proximate each other and said first and second deck members extend upwardly toward the respective inner side; and (d) first and second rearwardly-disposed ones of said cross-members on each of said deck members defining front and rear ends of a motor mount opening, which motor mount opening is adapted and configured to receive a motor mount, and which motor mount opening interrupts the generally regular spacing of said cross-members at a rear portion of said folding pontoon boat, the opening extending uninterrupted across the hinge line and outwardly from the hinge line, to opposing sides of said opening disposed inwardly of the outer sides of the respective deck members.

50. A folding pontoon boat as in claim 49, a rear end of said hinge being disposed adjacent the front end of the motor mount opening.

51. A folding pontoon boat as in claim 49, and including a second hinge hingedly connecting together the said cross-members which define the rear ends of the motor mount opening.

52. A folding pontoon boat as in claim 49, said cross-members which define the front and rear ends of the motor mount opening including slots therein extending transversely of a length of said folding pontoon boat.

53. A folding pontoon boat as in claim 49, including a support bar extending, on each deck member, between said rearward ones of said cross-members which define the front and the rear ends of the motor mount opening.

54. A folding pontoon boat as in claim 49 wherein said first and second pontoons fold with said deck members thereby to bring lower portions of said first and second pontoons into facing relationship with each other.

55. A folding pontoon boat as in claim 49 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

56. A folding pontoon boat, comprising:

(a) first and second elongate pontoons, each having a front end and a rear end;

(b) first and second deck members defining a deck of said folding pontoon boat, each of said first and second deck members having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon, said outer sides of said first and second deck members corresponding to opposing sides of said deck;

(c) a hinge hingedly connecting said inner sides of said first and second deck members to each other thereby to join said first and second deck members to each other for pivotation of said first and second deck members with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of the first and second deck members and between the front and rear ends of said first and second deck members, and wherein the outer sides of said first and second deck members comprise an outer edge of said deck, and a folded configuration wherein said first and second elongate pontoons are spaced proximate each other and said first and second deck members extend upwardly toward the respective inner sides; and (d) a motor mount mounted to said first and second deck members at locations at least some of which are displaced frontwardly of said rear ends of said deck members, said motor mount maintaining a substantially constant orientation when said folding pontoon boat is folded into the folded configuration.

57. A folding pontoon boat as in claim 56, said motor mount having a motor mounting locus positioned such that a lower drive unit of an outboard motor mounted thereto is positioned rearwardly of said first and second pontoons.

58. A folding pontoon boat as in claim 56, said deck members comprising transverse supporting cross-members extending transverse to a longitudinal axis of said folding pontoon boat, said motor mount further comprising support arms extending longitudinally of said pontoon boat and under and in contact with at least one said cross-member of each of said deck members when said folding pontoon boat is in the operating configuration and under full power.

59. A folding pontoon boat as in claim 56, said deck members comprising transverse supporting cross-members extending transverse to a longitudinal axis of said folding pontoon boat, said motor mount comprising suspension arms extending transverse to the longitudinal axis of said folding pontoon boat, said motor mount being mounted to said deck members by a combination of support bars in one of said cross-members and said suspension arms, and cooperating slots in the other of said cross-members and said suspension arms, said slots extending transversely of the longitudinal axis of said folding pontoon boat, said support bars sliding in said slots as said folding pontoon boat is converted between the operating configuration and the folded configuration.

60. A folding pontoon boat as in claim 59 wherein said motor mount rises, and thereby lifts a motor mounted to said motor mount, as said folding pontoon boat is being converted to the folded converted configuration.

61. A folding pontoon boat as in claim 59 wherein said motor mount defines a mounting plate structure oriented for holding an outboard motor thereon in a generally upright configuration for propelling said folding pontoon boat in the operating configuration, and wherein said motor mount maintains said mounting plate structure so oriented for holding such outboard motor in a generally upright configuration when said folding pontoon boat is being converted from the operating configuration to the folded configuration.

62. A folding pontoon boat as in claim 56 wherein, as said folding pontoon boat is converted from the operating configuration to the folded configuration, said motor mount lifts an outboard motor mounted to said motor mount a distance sufficient that such outboard motor mounted thereon can appropriately remain attached to said motor mount in an upright operating orientation during launching, loading, and trailering of said folding pontoon boat.

63. A folding pontoon boat as in claim 56, said first and second deck members each comprising an array of transverse structural cross-members spaced at generally regular intervals along respective lengths of the respective deck members, and wherein forward thrust of an outboard motor mounted on said motor mount is transferred to said deck members at one of said transverse supporting cross-members displaced frontwardly of said rear ends of said deck members by at least one said regular interval.

64. A folding pontoon boat as in claim 56 wherein said first and second pontoons fold with said deck members thereby to bring lower portions of said first and second pontoons into facing relationship with each other.

65. A folding pontoon boat as in claim 56 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

66. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon, said first and second deck members each comprising an array of transverse supporting cross-members which extend transverse to a longitudinal axis of said folding pontoon boat, said cross-members being spaced at generally regular intervals along the respective lengths of the respective deck members;

(c) a hinge hingedly connecting said inner sides of said first and second deck members to each other thereby to join said first and second deck members to each other for pivotation of said first and second deck members with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of the first and second deck members and between the front and rear ends of said first and second deck members, and wherein the outer sides of said first and second deck members comprise an outer edge of said deck, and a folded configuration wherein said first and second elongate pontoons are spaced proximate each other and said first and second deck members extend upwardly toward the respective inner sides; and (d) a motor mount mounted to said first and second deck members at locations at least some of which are displaced frontwardly of said rear ends of said deck members, said motor mount being so designed and configured that forward thrust of an outboard motor mounted to said motor mount is transferred to said transverse supporting cross-members at one or more locations displaced frontwardly of said rear ends of said deck members by at least one said regular interval.

67. A folding pontoon boat as in claim 66, said motor mount having a motor mounting locus positioned such that a lower drive unit of an outboard motor mounted thereto is positioned rearwardly of said first and second pontoons.

68. A folding pontoon boat as in claim 66, said motor mount further comprising support arms extending longitudinally of said pontoon boat and under and in contact with at least one said cross-member of each of said deck members when said folding pontoon boat is in the operating configuration and under full power.

69. A folding pontoon boat as in claim 66, said motor mount comprising suspension arms extending transverse to the longitudinal axis of said folding pontoon boat, said motor mount being mounted to said deck members by a combination of support bars in one of said cross-members and said suspension arms, and cooperating slots in the other of said cross-members and said suspension arms, said slots extending transversely of the longitudinal axis of said folding pontoon boat, said support bars sliding in said slots as said folding pontoon boat is converted between the operating configuration and the folded configuration.

70. A folding pontoon boat as in claim 69 wherein said motor mount rises, and thereby lifts a motor mounted to said motor mount, as said folding pontoon boat is being converted to the folded configuration.

71. A folding pontoon boat as in claim 69 wherein said motor mount defines a mounting plate structure oriented for holding an outboard motor thereon in a generally upright configuration for propelling said folding pontoon boat in the operating configuration, and wherein said motor mount maintains said mounting plate structure so oriented for holding such outboard motor in a generally upright configuration when said folding pontoon boat is being converted from the operating configuration to the folded configuration.

72. A folding pontoon boat as in claim 66 wherein, as said folding pontoon boat is converted from the operating configuration to the folded configuration, said motor mount lifts an outboard motor mounted to said motor mount a distance sufficient that such outboard motor mounted thereon can appropriately remain attached to said motor mount in an upright operating orientation during launching, loading, and trailering of said folding pontoon boat.

73. A folding pontoon boat as in claim 66 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

74. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon, said first and second deck members further comprising transverse supporting cross-members which extend transverse to a longitudinal axis of said folding pontoon boat;

(c) a hinge hingedly connecting said inner sides of said first and second deck members to each other thereby to join said first and second deck members to each other for pivotation of said first and second deck members with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of said first and second deck members and between the front and rear ends of said first and second deck members, and wherein the outer sides of said first and second deck members comprise outer edges of said deck, and a folded configuration wherein said first and second elongate pontoons are spaced proximate each other and said first and second deck members extend upwardly toward the respective inner sides; and (d) a motor mount mounted to said first and second deck members and so interfacing with said deck members that said motor mount rises as said first and second deck members are being extended upwardly when said folding pontoon boat is being converted to the folded configuration.

75. A folding pontoon boat as in claim 74, said motor mount having a motor mounting locus positioned such that a lower drive unit of an outboard motor mounted thereto is positioned rearwardly of said first and second pontoons.

76. A folding pontoon boat as in claim 74, said deck members comprising transverse supporting cross-members extending transverse to a longitudinal axis of said folding pontoon boat, said motor mount further comprising support arms extending longitudinally of said pontoon boat and under and in contact with at least one said cross-member of each of said deck members when said folding pontoon boat is in the operating configuration and under full power.

77. A folding pontoon boat as in claim 74, said deck members comprising transverse supporting cross-members extending transverse to a longitudinal axis of said folding pontoon boat, said motor mount comprising suspension arms extending transverse to the longitudinal axis of said folding pontoon boat, said motor mount being mounted to said deck members by a combination of support bars in one of said cross-members and said suspension arms, and cooperating slots in the other of said cross-members and said suspension arms, said slots extending transversely of the longitudinal axis of said folding pontoon boat, said support bars sliding in said slots as said folding pontoon boat is converted between the operating configuration and the folded configuration.

78. A folding pontoon boat as in claim 77 wherein said motor mount defines a mounting plate structure oriented for holding an outboard motor thereon in a generally upright configuration for propelling said folding pontoon boat in the operating configuration, and wherein said motor mount maintains said mounting plate structure so oriented for holding such outboard motor in a generally upright orientation when said folding pontoon boat is being converted from the operating configuration to the folded configuration.

79. A folding pontoon boat as in claim 74 wherein forward thrust of an outboard motor is transferred to said deck members at transverse supporting cross-members extending transverse to a longitudinal axis of said folding pontoon boat, said transverse supporting cross-members to which such thrust is transferred being mounted frontwardly of said rear ends of said deck members.

80. A folding pontoon boat as in claim 74 wherein, as said folding pontoon boat is converted from the operating configuration to the folded configuration, said motor mount lifts a motor mounted thereon a distance sufficient that such outboard motor can appropriately remain attached to said motor mount in an upright operating orientation during launching, loading, and trailering of said folding pontoon boat.

81. A folding pontoon boat as in claim 74 wherein said first and second pontoons fold with said deck members thereby to bring lower portions of said first and second pontoons into facing relationship with each other.

82. A folding pontoon boat as in claim 74 and including a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

83. A folding pontoon boat, comprising:

(a) first and second elongate pontoons, each having a front end and a rear end;

(b) first and second deck members, each having a front end and a rear end, a bottom, a top, an inner side, and an outer side, each said inner side having a top edge disposed toward the top of the respective deck member and a bottom edge disposed toward the bottom of the respective deck member, said front and rear ends of said first deck member being aligned with the respective front and rear ends of said first elongate pontoon, said front and rear ends of said second deck member being aligned with the respective front and rear ends of said second elongate pontoon;

(c) a hinge hingedly connecting said inner sides of said first and second deck members to each other thereby to join said first and second boat sections to each other for pivotation of said first and second boat sections with respect to each other, between an operating configuration wherein said first and second elongate pontoons are spaced at a first relatively greater distance from each other and said first and second deck members, in combination, define a deck of said folding pontoon boat, having a common top surface extending between the respective outer sides of said first and second deck members and between front and rear ends of said first and second deck members and wherein the outer sides of said first and second deck members comprise outer edges of said deck, and a folded configuration wherein said first and second deck members extend upwardly toward the respective inner sides; and (d) a retraction device having first and second ends, said first end being mounted to one of said first pontoon or said first deck member, said second end being mounted to one of said second pontoon or said second deck member, said retraction device having a line of retractive action passing below said hinge, whereby a line of force acting through said retraction device when said folding pontoon boat is in the operating configuration exerts an upward vector on said deck members sufficient to readily initiate upward movement of the inner sides of said deck members.

84. A folding pontoon boat as in claim 83, said retraction device comprising a 2-way hydraulic cylinder.

85. A folding pontoon boat as in claim 83, said retraction device comprising a ratchet and a flexible line, connecting said first and second boat sections to each other through the line of retractive action.

86. A folding pontoon boat as in claim 83, said first and second pontoons being non-pivotally secured to the respective said first and second deck members.

87. A folding pontoon boat as in claim 83, said first and second pontoons being fixedly secured to the respective said first and second deck members.

88. A folding pontoon boat as in claim 83wherein, in the folded configuration, said pontoons are spaced no more than about 3 inches from each other.

89. A folding pontoon boat as in claim 83 wherein, in the folded configuration, said pontoons are spaced about 1 inch from each other.

90. A folding pontoon boat as in claim 87, said hinge connecting said inner sides of said first and second deck members to each other at the respective bottom edges of said inner sides and wherein, in the folded configuration, said pontoons are spaced no more than about 3 inches from each other.

91. A folding pontoon boat as in claim 83, including a motor mount mounted to said boat sections, said motor mount having a motor mounting locus positioned such that a lower drive unit of an outboard motor mounted thereto is positioned rearwardly of said first and second pontoons.

92. A folding pontoon boat as in claim 83, including a motor mount mounted to said boat sections, said deck members comprising transverse supporting cross-members extending transverse to a longitudinal axis of said folding pontoon boat, said motor mount comprising support arms extending longitudinally of said pontoon boat and under and in contact with at least one said cross-member of each of said deck members when said folding pontoon boat is in the operating configuration and under full power.

93. A folding pontoon boat as in claim 83, including a motor mount mounted to said boat sections, said deck members comprising transverse supporting cross-members extending transverse to a longitudinal axis of said folding pontoon boat, said motor mount comprising suspension arms extending transverse to the longitudinal axis of said folding pontoon boat, said motor mount being mounted to said deck members by a combination of support bars in one of said cross-members and said suspension arms, and cooperating slots in the other of said cross-members and said suspension arms, said slots extending transversely of the longitudinal axis of said folding pontoon boat, said support bars sliding in said slots as said folding pontoon boat is converted between the operating configuration and the folded configuration.

94. A folding pontoon boat as in claim 83, including a motor mount mounted to said boat sections, and wherein said motor mount rises, and thereby lifts a motor mounted to said motor mount, as said folding pontoon boat is being converted to the folded configuration.

95. A folding pontoon boat as in claim 83, including a motor mount mounted to said boat sections, and wherein said motor mount defines a mounting plate structure oriented for holding an outboard motor thereon in a generally upright orientation for propelling said folding pontoon boat in the operating configuration, and wherein said motor mount maintains said mounting plate structure so oriented for holding such outboard motor in a generally upright orientation when said folding pontoon boat is being converted from the operating configuration to the folded configuration.

96. A folding pontoon boat as in claim 83, including a motor mount mounted to said boat sections, and wherein forward thrust of an outboard motor mounted to said motor mount is transferred to said deck members at transverse supporting cross-members extending transverse to a longitudinal axis of said folding pontoon boat, said transverse supporting cross-members to which such thrust is transferred being mounted frontwardly of said rear ends of said deck members.

97. A folding pontoon boat as in claim 83, including a motor mount mounted to said boat sections, and an outboard motor mounted thereon, wherein, as said folding pontoon boat is converted from the operating configuration to the folded configuration, said motor mount lifts said motor a distance sufficient that said outboard motor can remain attached to said motor mount in an upright operating orientation during launching, loading, and trailering of said folding pontoon boat.

98. A folding pontoon boat as in claim 83 wherein said first and second pontoons fold with said deck members thereby to bring lower portions of said first and second pontoons into facing relationship with each other.

99. A folding pontoon boat as in claim 90, including a motor mount mounted to said boat sections, said deck members comprising transverse supporting cross-members extending transverse to a longitudinal axis of said folding pontoon boat, said motor mount comprising suspension arms extending transverse to the longitudinal axis of said folding pontoon boat, said motor mount being mounted to said deck members by a combination of support bars in one of said cross-members and said suspension arms, and cooperating slots in the other of said cross-members and said suspension arms, said slots extending transversely of the longitudinal axis of said folding pontoon boat; said support bars sliding in said slots as said folding pontoon boat is converted between the operating configuration and the folded configuration.

100. A folding pontoon boat as in claim 99 and including first and second jamb plates secured to respective first and second deck members at said inner sides of said deck members.

101. A folding pontoon boat as in claim 100 wherein said first pontoon is secured to said first deck member proximate the outer side of said first deck member and said second pontoon is secured to said second deck member proximate the outer side of said second deck member.

* * * * *